United States Patent [19]

Ogawa et al.

[11] 4,362,795

[45] Dec. 7, 1982

[54] PROCESS FOR FORMING PHOTOGRAPHIC IMAGES AND PHOTOGRAPHIC LIGHT-SENSITIVE MATERIAL FOR USE THEREIN

[75] Inventors: Junkichi Ogawa; Minoru Yamada; Tsutomu Hamaoka, all of Minami-ashigara, Japan

[73] Assignee: Fuji Photo Film Co., Ltd., Kanagawa, Japan

[21] Appl. No.: 182,545

[22] Filed: Aug. 29, 1980

[30] Foreign Application Priority Data

Aug. 29, 1979 [JP] Japan ..... 54-110002

[51] Int. Cl.[3] ..... G03C 7/00

[52] U.S. Cl. ..... 430/9; 430/350; 430/364; 430/380; 430/405; 430/440; 430/553; 430/966

[58] Field of Search ..... 430/364, 380, 385, 440, 430/441, 553, 363, 966, 967, 483, 485, 551, 565, 9, 405, 350

[56] References Cited

U.S. PATENT DOCUMENTS

| | | | |
|---|---|---|---|
| 2,735,765 | 2/1956 | Loria et al. | 430/551 |
| 3,161,513 | 12/1964 | Henn | 430/440 |
| 4,049,454 | 9/1977 | Van Doorselaer et al. | 430/364 |
| 4,217,410 | 8/1980 | Nakamura et al. | 430/551 |
| 4,268,616 | 5/1981 | Ogawa et al. | 430/565 |

FOREIGN PATENT DOCUMENTS 1122085 7/1968 United Kingdom .

*Primary Examiner*—J. Travis Brown

*Attorney, Agent, or Firm*—Sughrue, Mion, Zinn, Macpeak & Seas

[57] ABSTRACT

A process for forming photographic images comprising a silver image and a dye image, comprising development processing an imagewise exposed silver halide photographic light-sensitive material containing a 4-alkoxy-1-naphthol represented by the formula (I)

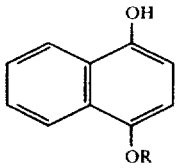

(I)

wherein R represents an alkyl group, an alkoxyalkyl group, or a hydroxyalkyl group, and the number of carbon atoms in the substituent represented by R is from 1 to 4.

The process of this invention is particularly useful in the field of X-ray photography, in order to provide an image of increased density for a given silver content. A novel silver halide photographic light-sensitive material includes the above 4-alkoxy-1-naphthol in a photographic colloid layer thereof, preferably the silver halide emulsion layer.

42 Claims, No Drawings

PROCESS FOR FORMING PHOTOGRAPHIC IMAGES AND PHOTOGRAPHIC LIGHT-SENSITIVE MATERIAL FOR USE THEREIN

BACKGROUND OF THE INVENTION

1. Field of the Invention

This invention relates to a novel process for forming photographic images and, more particularly, to a process for obtaining sufficient image density from a silver halide photographic light-sensitive material which contains a relatively low amount of coated silver. The invention also relates to a silver halide photographic light-sensitive material for use in such a process.

2. Discussion of the Prior Art

In ordinary processes for forming black-and-white photographic images, a latent image is formed in a silver halide photographic light-sensitive material by imagewise-exposure, and the light-sensitive material is then developed with a developer (i.e., a developing solution) containing a conventional black-and-white developing agent such as hydroquinone, N-methyl-p-aminophenyl, 1-phenyl-3-pyrazolidone, etc. The metallic silver formed in the latent image areas is useful as a black-and-white image. Upon development processing, the oxidation product of the developing agent formed is removed from the system as an unnecessary material.

Imagewise formation of a dye utilizing the oxidation product of the developing agent provides an image density which is the sum of the silver density and the dye density and, as a result, enables a reduction in the amount of silver required to be coated.

Various processes have been proposed directed to reducing the amount of silver. For example, there is a process for forming a silver image and a dye image at the same time using a color developer compound having in the molecule a residue which functions as a developing agent and a residue which functions as a coupler capable of coupling with an oxidation product of the former residue to form a dye, thus reducing the amount of coated silver, as described in U.S. Pat. Nos. 3,615,509 and 3,622,629. Also, there is a process for forming a black image using both p-phenylenediamine derivative and phenol or naphphol, or an active methylene compound, as described in U.S. Pat. No. 2,181,944. Furthermore a black image has been formed using, as a developing agent, 3-aminopyrazolobenzimidaxole and, as a coupler, an active methylene compound, as described in West German Pat. No. 1,158,836.

British Pat. No. 492,518 and West German Pat. No. 537,923 disclose a process for forming a black image by mixing couplers commonly used in conventional color photographic process which can form yellow, magenta and cyan dyes, respectively, and conducting color development, Japanese Patent Application (OPI) No. 37539/72 (the term "OPI" as used herein refers to a "published unexamined Japanese patent application") descloses a process for forming a dye image and a silver image at the same time by conducting color development in the presence of a color coupler and fixing without removing silver, thus reducing the amount of silver to be coated. Japanese Patent Application (OPI) No. 42725/77 discloses a process of forming a black image by using an m-aminophenol derivative as a coupler, and Japanese Patent Application (OPI) No. 57827/77 discloses a process of obtaining a black image by using a multifunctional coupler and a multifunctional developing agent. Furthermore, a process using a large number of self-coupling developing agents and peroxides is disclosed in British Pat. No. 1,268,126.

However, so far the foregoing processes have not been capable of being put into commercial practice due to the difficulty in obtaining high image density for the amount of coated silver, or due to the comparatively high price of the materials for forming images.

In British Pat. No. 1,122,085, a process for forming images comprising a silver image and a dye image by adding compounds somewhat similar to those used in the present invention to a developer solution is disclosed. However, the granularity of the images formed using this process is poor, and in addition, the alkoxynaphthols described therein are very rapidly oxidized by air in an alkali to form compounds which are slightly soluble in water. When a light-sensitive material can be processed in a developer solution containing alkoxynaphthols which are readily oxidized by air as described above, severe fog is formed which is troublesome in practical use.

SUMMARY OF THE INVENTION

A first object of this invention is to provide a process for forming an image having a high maximum density using a silver halide photographic light-sensitive material containing a lower amount of coated silver than is conventionally required to obtain such density.

A second object of this invention is to provide a process for forming an image having improved granularity.

A third object of this invention is to provide a process for forming an image using a developer solution having good durability.

A fourth object of this invention is to provide a silver halide photographic light-sensitive material containing a lower amount of coated silver in which a black-and-white photographic image having a high maximum density is produced.

A fifth object of this invention is to provide a silver halide photographic light-sensitive material in which a black-and-white photographic image having improved granularity is produced.

A sixth objects of this invention is to provide a silver halide photographic light-sensitive material is produced, using a developer solution having good durability.

These objects of this invention have been attained by development processing an imagewise exposed silver halide photographic light-sensitive material containing a compound represented by the formula (I)

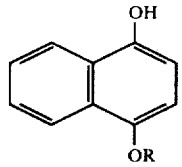

(I)

wherein R represents an alkyl group, an alkoxyalkyl group, or a hydroxyalkyl group, and the number of carbon atoms in the substituent represented by R is from 1 to 4.

The process of this invention is particularly useful in the field of X-ray photography.

Furthermore, these objects of this invention have been attained by incorporating a 4-alkoxy-1-naphthol represented by formula (I) as set forth below into at least one hydrophilic colloid layer in a silver halide light-sensitive material

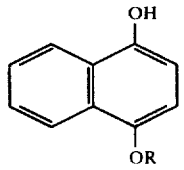

(I)

wherein R represents an alkyl group, an alkoxyalkyl group or a hydroxyalkyl group and the number of carbon atoms in the substituent represented by R is from 1 to 4.

DETAILED DESCRIPTION OF THE INVENTION

It has been found that images having extremely good granularity are obtained by the incorporation of alkoxynaphthols according to formula (I) into light-sensitive materials according to this invention, although the reason therefor is unknown. Since it is not necessary to add the alkoxynaphthols to a developer solution, preservation of the developer solution is markedly improved. Further, the light-sensitive material containing the alkoxynaphthols does not sustain degradation due to oxidation by air during storage. Thus, the stability of photographic system is surprisingly improved by the incorporation of the alkoxynaphthols into light-sensitive materials.

Photographic images formed by the process of this invention comprise a silver image and a dye image. This dye image is different than that in a conventional color photographic light-sensitive material in that it is not formed by the reaction between a color coupler and a oxidation product of aromatic primary amine developing agent. Also, it is different from the dye image formed by the autocoupling of a compound containing both a silver halide-developing moiety and a color coupler moiety in the same molecule (developer-coupler compound).

Specific examples of the alkoxy naphthol compounds useful in this invention are listed below. However, this invention is not limited to the use of these compounds.

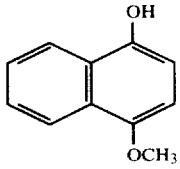

I-1

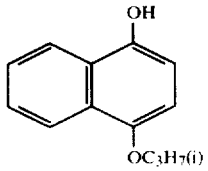

I-2

-continued

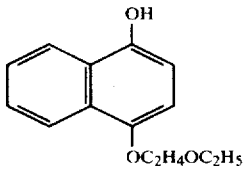

I-3

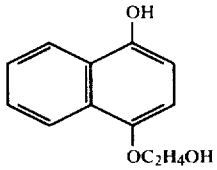

I-4

These compounds are described in J. Kosar: *Light-Sensitive Systems,* published by John Wiley Co. (1965), pages 237 to 240, and in British Pat. No. 1,122,085.

As the naphthalene compounds used in this invention commercially available compounds can be employed. The methods for preparation of these compounds are set forth, for example, in Munio Kotake: *Daiyukikagaku,* Vol. 11, pages 210 to 217.

The coated amount of the naphthol compounds according to this invention preferably ranges from about 0.1 to 10 g/m$^2$, and more preferably from 0.2 to 5 g/m$^2$.

Although the same compounds as described in the above noted British Pat. No. 1,122,085 are utilized in this invention, this invention is based on the unexpected discoveries that fog is reduced, the granularity is improved, and the durability of the developer solution is improved by the incorporation of such compounds into light-sensitive materials.

In the process of this invention, a 3-pyrazolidone or a hydroquinone is added alone or in combination to a developer solution of the light-sensitive material as an auxiliary developing agent.

Preferred 3-pyrazolidones to be used in the process of the invention can be represented by formula (II)

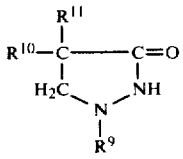

(II)

wherein $R^9$ represents an aryl group, and $R^{10}$ and $R^{11}$ each represents hydrogen, an alkyl group, or a hydroxyalkyl group, preferably, one of $R^{10}$ and $R^{11}$ represents an hydroxyalkyl group and the other represents an alkyl group.

The aryl group represented by $R^9$ is preferably a phenyl group. Preferably, this aryl group is not substituted.

The alkyl and hydroxyalkyl groups represented by $R^{10}$ and $R^{11}$ preferably contain from 1 to 4 carbon atoms and is illustrated by for example, a methyl group, an ethyl group, an n-propyl group, an i-propyl group, an n-butyl group, a tert-butyl group, and so forth.

Examples of the hydroquinones which can be incorporated into the light-sensitive material used in the process of this invention include hydroquinone, a mono- or di-alkylhydroquinone (a number of the carbon atoms included in the alkyl group being 1 to 4) or a phenylhydroquinone.

The silver image formed by the process of this invention is substantially black, but it includes images tinged with other colors, such as brown or blue. The dye image formed by the process of this invention may be of any color as long as it has an absorption in the visible region of the spectrum. This dye image lies on the silver image to increase the total image density and, therefore, enables one to reduce the amount of coated silver necessary to obtain a desired image density.

The processing used in this invention comprises a developing step and a fixing step and, if desired, a water-washing step and a stopping step may be provided. A drying step may also be provided at the end of the processing.

The processing temperature is usually from about 10° C. to 70° C., preferably from about 20° C. to 60° C. and particularly preferably from about 20° C. to 40° C. The pH of the developer solution used in the developing step is usually from about 10 to 14, preferably from about 11 to 14, and particularly preferably from about 12 to 14.

The developer solution may also contain other known developer component compounds besides the above described 3-pyrazolidones and hydroquinones. For example, as an alkali, a buffer agent, etc., sodium hydroxide, potassium hydroxide, sodium carbonate, potassium carbonate, sodium or potassium tertiary phosphate, potassium metaborate, borax, etc. may be used alone or in combination. Also, in order to impart buffering action or raise the ionic strength of the developer, or for the convenience of preparing processing solutions, various salts may be used such as disodium or dipotassium hydrogen phosphate, potassium or sodium dihydrogen phosphate, sodium or potassium bicarbonate, boric acid, alkali metal nitrates, alkali metal sulfates, etc.

An antifogging agent may be optionally incorporated into the developer. As such an antifogging agent alkali metal halides (e.g., potassium bromide, sodium bromide, potassium iodide, etc.) and organic antifogging agents can be used. Examples of organic antifogging agent are nitrogen-containing heterocyclic ring compounds (e.g., benzotriazole, 6-nitrobenzimidazole, 5-nitroisoindazole, 5-methylbenzotriazole, 5-nitrobenzotriazole, 5-chlorobenzotriazole, etc.), mercapto-substituted heterocyclic ring compounds (e.g., 1-phenyl-5-mercaptotetrazole, 2-mercaptobenzimidazole, 2-mercaptobenzothiazole, etc.), and mercapto-substituted aromatic compounds (e.g., thiosalicyclic acid). Particularly preferred antifogging agents are nitrogen-containing heterocyclic ring compounds, especially nitrogen-containing heterocyclic ring compounds not substituted by a mercapto group. The antifogging agents are generally used in an amount of $5\times10^{-6}$ to $3\times10^{-2}$ mol preferably $3\times10^{-6}$ to $6\times10^{-1}$ mol, per 1 liter of the developer.

Additional examples of nitrogen-containing heterocyclic ring compounds not substituted by a mercapto group are described in the following literature: Nitrobenzimidazole compounds are described in U.S. Pat. No. 2,496,940, British Pat. No. 403,789, U.S. Pat. Nos. 2,497,917, 2,656,271, etc. Benzotriazole compounds are described in *Journal of the Photographic Society of Japan*, 11, 48 (1948). Heterocyclic ring quaternary salts such as benzothiazolium salts are described in U.S. Pat. Nos. 2,131,038, 2,694,716, 3,326,681, etc. Tetrazaindene compounds are described in U.S. Pat. Nos. 2,444,605, 2,444,606, 2,444,607, etc., and other heterocyclic ring compounds described in U.S. Pat. Nos. 2,173,628, 2,324,123, 2,444,608, etc. Additional useful antifogging agents are described in *Kagaku Shashin Binran*, Vol. II, p. 119 (Maruzen, 1959).

Further, hydroxylamine sulfate or hydrochloride, sodium sulfite, potassium sulfite, potassium bisulfite, or sodium bisulfite can be added to the developer.

Optionally, development accelerators may be added to the developer, if desired. Such development accelerators include cationic compounds such as various pyridinium compounds such as those described in U.S. Pat. No. 2,648,604, Japanese Patent Publication No. 9503/69 and U.S. Pat. No. 3,671,247, etc., cationic dyes such as phenosafranine, etc., neutral salts such as thallium nitrate, potassium nitrate, etc., nonionic compounds such as polyethylene glycol or the derivative thereof described in Japanese Patent Publication No. 9504/69, U.S. Pat. Nos. 2,533,990, 2,531,832, 2,950,970, and 2,577,127, etc., and polythioethers, organic solvents described in Japanese Patent Publication No. 9509/69 and Belgian Pat. No. 682,862, organic amines, ethanolamine, ethylenediamine diethanolamine, etc. In addition, there are included accelerators described in L.F.A. Mason: *Photographic Processing Chemistry*, pp. 40–43 (Focal Press, London, 1966).

Furthermore, benzyl alcohol, phenylethyl alcohol described in U.S. Pat. No. 2,515,147, pyridine as described in *Journal of the Photographic Society of Japan*, Vol. 14, p. 74 (1952), ammonia, hydrazine, amines, etc. are effective development accelerators. Preferred example of development accelerator is benzyl alcohol.

In order to introduce the 4-alkoxy-1-naphthol compounds useful according to this invention into a hydrophilic colloid constituting a silver halide photographic light-sensitive material, various known processes can be employed. The 4-alkoxy-1-naphthol compounds is soluble in organic solvents, it can be added to the hydrophilic colloid constituting a photographic layer as a solution by dissolving it in a solvent which does not detrimentally influence the photographic properties. Such solvents are selected from among low-boiling organic solvents and water-miscible organic solvents such as alcohols (e.g., methanol, ethanol, isopropanol, butanol, etc.), ethers (e.g., dimethyl ether, ethyl methyl ether, diethyl ether, 1-ethoxypropane, etc.), glycols (e.g., 1,2-ethanediol, 1,2-propanediol, 1,3-propanediol, etc.), ketones (e.g., acetone, methyl ethyl ketone, 3-pentanone, etc.), esters (e.g., ethyl formate, methyl acetate, ethyl acetate, etc.) and amides (e.g., formamide, acetamide, succinic acid amide, etc.).

As an alternative process for introducing the naphthol compound of this invention into the hydrophilic colloid constituting a photographic layer, known processes for adding color couplers to hydrophilic colloid layers by emulsification can be employed. Particularly, the 4-alkoxy-1-nephthol compound may be dissolved in an organic solvent in the manner described in U.S. Pat. Nos. 2,322,027 or 2,304,939, etc., emulsified and dispersed using a surface active agent, and the resulting emulsion dispersion added to a photographic hydrophilic colloid. As organic solvents suited for this purpose, high-boiling organic solvents having a boiling point higher than about 175° C. and low-boiling organic solvents having a boiling point of about 30° C. to about 150° C. can be used alone or in combination (in optional proportions). As the low-boiling organic solvent, those illustrated hereinafter can be used. Examples of useful high-boiling solvents include di-n-butyl phthalate, benzyl phthalate, triphenyl phosphate, tri-o-cresyl phosphate, diphenylmono-p-tert-butylphenyl phosphate, monophenyldi-p-tert-butylphenyl phosphate, diphenylmono-o-chlorophenyl phosphate, monophenyldi-o-chlorophenyl phosphate, 2,4-di-n-amylphenol, 2,4-di-t-amylphenol, N,N-diethyllaurylamide, and trioctyl phosphate and trihexyl phosphate, etc. described in U.S. Pat. No. 3,676,137. A preferred process is a dispersion method using a latex, for example, those described in U.S. Pat. No. 3,518,088 and Japanese Patent Application (OPI) Nos. 59942/76 and 59943/76.

When 3-pyrazolidones or hydroquinones are introduced into the light-sensitive material, the same processes as those used for the naphthol compounds can be applied.

The naphthol compound of this invention can be introduced into a hydrophilic colloid constituting a photographic light-sensitive material in any of the steps for producing photographic light-sensitive materials, with the steps prior to coating, in particular the step of preparing the photographic coating solution, being desirable.

The naphthol compound of this invention can be added to either a photographic emulsion layer or an auxiliary layer.

Ordinary photographic materials for photographs contain 3 to 10 g/m$^2$ silver salts (calculated as silver), and printing materials contain about 1 to 4 g/m$^2$ silver. On the other hand, the photographic material of this invention contains silver halide in an amount of from about 0.1 to 8 gAg/m$^2$ (the expression gAg/m$^2$ refers to the concentration of silver present in the form of silver halide), and in general the amount of silver can be reduced at least about 20% in comparison with an analogous conventional type photographic material put to the same use.

A silver halide emulsion is usually prepared by mixing a solution of water-soluble silver salt (e.g., silver nitrate, etc.) with a solution of a water-soluble halide (e.g., potassium bromide, etc.) in the presence of a solution of a water-soluble polymer such as gelatin. As the silver halide, mixed silver halides can be used, such as silver chlorobromide, silver bromoiodide, silver chlorobromoidodide, etc. as well as silver chloride and silver bromide. The form of these silver halide grains may be cubic, octahedral, or mixed forms thereof.

Also, two or more silver halide photographic emulsions separately prepared may be used by mixing them. Furthermore, silver halide grains which are uniform to the core, silver halide grains wherein the inner portion and exterior portion form different layers, and so-called conversion type silver halides, and described in British Pat. No. 635,841 and U.S. Pat. No. 3,622,318 may be used. Either a silver halide forming a latent image mainly on the surface of the grain or a silver halide forming a latent image within the grain may be used. Such photographic emulsions are also described in Mees: *The Theory of Photographic Process*, 4th Edition, published by MacMillan Co. edition by J. H. James, pp. 88 to 102 (1977), P. Glafkides: *Chimie Photographique*, published by Paul Montel, pp. 251 to 308 (1957), and the like, and can be prepared according to various generally known processes, such as an ammoniacal process, a neutral process, an acidic process, etc.

The above-described silver halide emulsion can be chemically sensitized in the conventional manner. As the chemical sensitizing agents, there are illustrated, for example, gold compounds such as chloroauric acid salt, auric chloride, etc. as described in U.S. Pat. Nos. 2,399,083, 2,540,085, 2,597,856 and 2,597,915, salts of noble metals such as platinum, palladium, iridium, rhodium, ruthenium, etc. described in U.S. Pat. Nos. 2,448,060, 2,540,086, 2,566,245, 2,566,263, 2,598,079, etc., sulfur compound capable of reacting with a silver salt to form silver sulfide, as described in U.S. Pat. Nos. 1,574,944, 2,410,689, 3,189,458, 3,501,313, etc., stannous salts as described in U.S. Pat. Nos. 2,487,850, 2,518,698, 2,521,925, 2,521,926, 2,694,637, 2,983,610, 3,201,254, etc., amines and other reducing substances.

Antifogging agents added to a light-sensitive silver halide emulsion and non-light-sensitive auxiliary layers of a light-sensitive material may generally be used in combination with the compounds of this invention. As other additives, a hardener, plasticizer, lubricant, surface agent, brightening agent and others known in the photographic field may be incorporated in a photographic element.

As the hydrophilic colloid used, there are illustrated, for example, gelatin, colloidal albumin, casein, cellulose derivatives (e.g., carboxymethyl cellulose, hydroxyethyl cellulose, etc.), sugar derivatives (e.g., agar-agar, sodium aliginate, starch derivative, etc.), synthetic hydrophilic colloids (e.g., polyvinyl alcohol, poly-N-vinyl pyrrolidone, polyacrylic acid copolymer, polyacrylamide, the derivatives or partially hydrolyzed products thereof, etc.). If necessary, a compatible mixture of two or more of these colloids may be used. Of these, the most generally used is gelatin. Gelatin can be replaced partially or wholly by a synthetic polymer and, in addition, so-called gelatin derivatives may be used.

The photographic emulsions may, if desired, be subjected to spectral sensitization or supersensitization using cyanine dyes such as cyanine, merocyanine, carbocyanine, etc. alone or in combination, or in further combination with styryl dyes, etc. Color-sensitizing techniques are well known and, for example, there are related descriptions in U.S. Pat. Nos. 2,493,748, 2,519,001, 2,977,229, 3,480,434, 3,672,897, 3,703,377, 2,688,545, 2,912,329, 3,397,060, 3,615,635, 3,628,964, British Pat. Nos. 1,195,302, 1,242,588, 1,293,862, West German Patent (OPI) Nos. 2,030,326, 2,121,780, Japanese Patent Publication Nos. 4936/68, 14030/69, 10773/68, U.S. Pat. Nos. 3,511,664, 3,522,052, 3,527,641, 3,615,613, 3,615,632, 3,617,295, 3,635,721, 3,694,217, British Pat. Nos. 1,137,580, 1,216,203, etc. These techniques can be selected based on the end-use of the light-sensitive materials such as the wavelength region to be sensitized, the sensitivity, and the like.

As the photographic support, there are illustrated a cellulose nitrate film, a cellulose acetate film, a cellulose butyrate film, a cellulose acetate propionate film, a polystyrene film, a polyethylene terephthalate film, a polycarbonate film, laminates thereof, thin glass film, paper, etc. commonly used for photographic light-sensitive materials. Papers coated or laminated with baryta or $\alpha$-olefin polymers, in particular polymers of $\alpha$-olefins having 2 to 10 carbon atoms such as polyethylene, polypropylene, ethylene-butene copolymer, etc. plastic films whose surface has been made rough to improve the adhesive property with other polymer substances as described in Japanese Patent Publication No. 19068/72, and the like supports can also provide good results.

As the suitable supports, transparent or opaque supports selected depending upon the end-use of the light-sensitive materials may be used. Also, with respect to transparent supports, not only can colorless transparent supports be used, but transparent supports colored by adding dyes or pigments can be used as well. This has therefore been conducted with X-ray film and is disclosed, for example, in *J. SMPTE,* Vol. 67, p. 296 (1958), etc.

Opaque supports include those made of essentially opaque materials like paper and, in addition, those prepared by adding dyes or pigments like titanium oxide to a transparent film, a plastic film having been surface-treated according to the method described in Japanese Patent Publication No. 19068/72, papers or plastic films to which carbon black, dyes or the like have been added to make them completely light-intercepting, and the like. Also, a subbing layer may be provided having adhesiveness for both the support and the photographic emulsion layer. In order to further improve the adhesion property, the surface of the support may be subjected to pretreatments such as corona discharge, irradiation with ultraviolet rays, flame treatment, etc.

The photographic element layer may be coated according to various coating methods including dip-coating, air-knife coating, curtain coating, and extrusion coating using a hopper as described in U.S. Pat. No. 2,681,294.

This invention will be described in more detail in the following examples. This invention is not, however, limited to the specific embodiments of the examples.

EXAMPLE 1

A photographic light-sensitive material comprising a polyethylene terephthalate film having coated on one side thereof a gelatino-silver bromoiodide emulsion (silver iodide: 1.5 mol%) containing 10 g/mol Ag of the compound of this invention as described in Table 1 below added as a methanol solution, in an amount of 40 mg of silver (present as silver halide) per 100 $cm^2$ and 50 mg of gelatin per 100 $cm^2$, and a gelatin protective layer in an amount of 20 mg per 100 $cm^2$ was exposed under an optical wedge and subjected to the following processing steps using a roller-conveying type processor as described below.

| Step | Processing Temperature | Processing Time |
|---|---|---|
| Development | 35° C. | 25 sec |
| Fixing | 34° C. | 25 sec |
| Washing | 33° C. | 25 sec |
| Drying | 50° C. | 15 sec |

Composition of the developer and the fixing solution used were as follows.

| | |
|---|---|
| Developer A | |
| Water | 500 ml |
| Hydroxyethylethylenediaminetriacetic Acid | 0.8 g |
| Sodium Sulfite (anhydrous) | 10.0 g |
| Potassium Hydroxide | 80.0 g |
| 1-Phenyl-3-pyrazolidone | 1.0 g |
| Glutaraldehyde (25% aq. solution) | 5.0 g |
| 5-Nitro-indazole | 0.03 g |
| 1-Phenyl-5-mercaptotetrazole | 0.005 g |
| 5-Methylbenzotriazole | 0.005 g |
| Potassium Bromide | 16.0 g |
| Water to make | 1.0 liter |
| Fixing solution | |
| Water | 500 ml |
| Ammonium Thiosulfate | 200.0 g |
| Sodium Sulfite (anhydrous) | 20.0 g |
| Boric Acid | 8.0 g |
| Disodium Ethylenediaminetetraacetate | 0.1 g |
| Aluminum Sulfate | 15.0 g |
| Sulfuric Acid | 2.0 g |
| Glacial Acetic Acid | 22.0 g |
| Water to make | 1.0 liter |

The processor used was "Fuji RN (made by Fuji Photo Film Co., Ltd.)", an automatic developer for X-ray film, which requires 90 seconds for the total processing.

For comparison, a light-sensitive material identical to that described above, except not containing the 4-alkoxy-1-naphthol compound, was processed in the same manner as described above using a developer (Developer B) which was prepared by adding 30 g/liter of hydroquinone to the above described developer.

The data of photographic properties obtained are shown in Table 1 below.

TABLE 1

| | Test Condition | | | | Result | |
|---|---|---|---|---|---|---|
| | Coated Silver | Naphthol Compound | | | | |
| Test No. | Amount g/$m^2$ | Compound | Amount Coated g/mol Ag | Developer | Maximum Density | Fog |
| 1 | 4 | 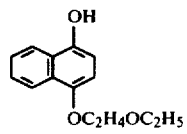 | 10 | Developer A | 2.97 | 0.22 |
| 2 | 4 | 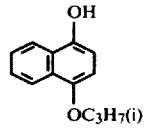 | 10 | " | 2.83 | 0.24 |
| 3 | 4 | 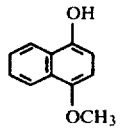 | 10 | " | 3.11 | 0.23 |

TABLE 1-continued

| Test No. | Test Condition: Coated Silver Amount g/m² | Naphthol Compound: Compound | Naphthol Compound: Amount Coated g/mol Ag | Developer | Result: Maximum Density | Result: Fog |
|---|---|---|---|---|---|---|
| 4(Comparison) | 4 | none | 0 | Developer B* | 1.61 | 0.21 |

*This developer is the most common one. When Developer A was applied to this light sensitive material, much poorer photographic property was obtained.

It is apparent from the results shown above, the light-sensitive material containing the naphthol compound according to this invention provides extremely high maximum density in comparison with the light-sensitive material not containing the naphthol compound. Particularly, the optical density increases due to the amount of dye formed, and the amount of silver coated can be saved in proportion thereto.

EXAMPLE 2

A comparative experiment of preservation of a developer containing an alkoxynaphthol according to the invention and a developer not containing such compound (this invention) was carried out. Developer C was prepared by adding 50 ml/liter of a 10% methanol solution of 4-methoxy-1-naphthol to Developer A. The conditions for development processing were the same as described in Example 1. The results are shown in Table 2 below.

TABLE 2

| Test No. | Test Condition: Coated Silver amount g/m² | Naphthol Compound: Compound | Naphthol Compound: Amount Coated g/mol Ag | Developer | Just after Preparation: Maximum Density | Just after Preparation: Fog | After 1 day*: Maximum Density | After 1 day*: Fog |
|---|---|---|---|---|---|---|---|---|
| 5 | 4 | 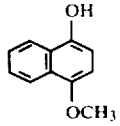 (added as a methanol solution) | 10 | Developer A | 3.11 | 0.23 | 3.08 | 0.24 |
| 6 | 4 | none | 0 | Developer C** | 2.87 | 0.51 | 3.02 | 0.76 |

*The developer was allowed to stand in a beaker at room temperature.
**This developer is the most common one. When Developer A was applied to this light sensitive material, much poorer photographic properties were obtained.

It is apparent from the results shown above that when the alkoxynaphthol compound is added to the developer, the developer is readily oxidized by air and fog is formed. On the contrary, when the alkoxynaphthol is added to the light-sensitive material, the preservation of the developer is improved.

EXAMPLE 3

The granularity of images which were formed by adding the alkoxynaphthol to a developer and images which were formed by adding the alkoxynaphthol to a light-sensitive material were compared by measuring RMS granularity (the term "RMS" as used herein refers to root mean square.). The light-sensitive material and the developer were the same as those used in Example 2. The results are shown in Table 3 below.

TABLE 3

| Test No. | Test Condition: Coated Silver amount g/m² | Naphthol Compound: Compound | Naphthol Compound: Amount Coated g/mol Ag | Developer | Granularity RMS value at Density of 1.0 (Aperture: 48 μΦ) |
|---|---|---|---|---|---|
| 7 | 4 | 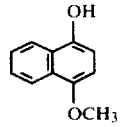 | 10 | Developer A | 0.043 |
| 8 | 4 | none | 0 | Developer C* | 0.071 |

*This developer is the most common one. When Developer A was applied to this light sensitive material, much poorer photographic property was obtained.

As is apparent from the results shown above, when the alkoxynaphthol is added to the light-sensitive material the granularity is greatly improved.

While the invention has been described in detail and with reference to specific embodiments thereof, it will be apparent to one skilled in the art that various changes and modifications can be made therein without departing from the spirit and scope thereof.

What is claimed is:

1. In a process for forming a photographic image comprising a silver image of improved granularity and a dye image, comprising development processing an imagewise-exposed silver halide photographic light-sensitive material, the improvement wherein said development processing is carried out in the presence of a 4-alkoxy-1-naphthol represented by the formula (I)

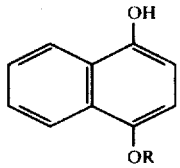

(I)

wherein R represents an alkyl group, an alkoxyalkyl group, or a hydroxyalkyl group, and the number of carbon atoms in the substituent represented by R is from 1 to 4, which is incorporated into said silver halide photographic light-sensitive material.

2. A process for forming a photographic image as in claim 1, wherein said 4-alkoxy-1-naphthol is 4-methoxy-1-naphthol.

3. A process for forming a photographic image as in claim 1, wherein said 4-alkoxy-1-naphthol is 4-isopropoxy-1-naphthol.

4. A process for forming a photographic image as in claim 1, wherein said 4-alkoxy-1-naphthol is 4-$\beta$-ethoxyethoxy-1-naphthol.

5. A process for forming a photographic image as in claim 1, wherein said 4-alkoxy-1-naphthol is 4-$\beta$-hydroxyethyl-1-naphthol.

6. A process for forming a photographic image as in claim 1, wherein the 4-alkoxy-1-naphthol represented by formula (I) is incorporated into said photographic light-sensitive material in an amount of from about 0.1 g/m$^2$ to 10 g/m$^2$.

7. A process for forming a photographic image as in claim 1, wherein said 4-alkoxy-1-naphthol is incorporated into said photographic light-sensitive material in an amount of from 0.2 g/m$^2$ to 5 g/m$^2$.

8. A process for forming a photographic image as in claim 1 wherein said 4-alkoxy-1-naphthol is incorporated into a hydrophilic colloid layer constituting said silver halide photographic light-sensitive material.

9. A process for forming a photographic image as in claim 8, wherein said hydrophilic colloid layer is a silver halide emulsion layer.

10. A process for forming photographic images as in claim 1, wherein said hydrophilic colloid layer is an auxiliary layer.

11. A process for forming a photographic image as in claim 1, wherein said photographic light-sensitive material contains silver halide in an amount of from about 0.1 gAg/m$^2$ to 8 gAg/m$^2$.

12. A process for forming a photographic image as in claim 1, wherein said development processing comprises a developing step and a fixing step.

13. A process for forming a photographic image as in claim 12, wherein said developing step is carried out using a developer having a pH of from about 10 to 14.

14. A process for forming a photographic image as in claim 12, wherein said developing step is carried out using a developer having pH of from 11 to 14.

15. A process for forming a photographic image as in claim 12, wherein said developing step is carried out using a developer having a pH of from 12 to 14.

16. A process for forming a photographic image as in claim 1, wherein said development processing is carried out in the presence of a 3-pyrazolidone compound.

17. A process for forming a photographic image as in claim 16, wherein said 3-pyrazolidone compound is represented by the formula (II)

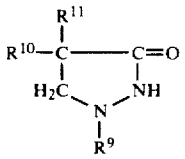

(II)

wherein $R^9$ represents an aryl group; and $R^{10}$ and $R^{11}$ each represents hydrogen, an alkyl group, or a hydroxyalkyl group.

18. A process for forming a photographic image as in claim 16, wherein said 3-pyrazolidone compound is incorporated into said photographic light-sensitive material.

19. A process for forming a photographic image as in claim 16, wherein said 3-pyrazolidone compound is incorporated into a developer.

20. A process for forming a photographic image in claim 8, wherein said 4-alkoxy-1-naphthol is present in an emulsion dispersion or in latex dispersion.

21. A process for forming a photographic image as in claim 20, wherein the development processing is carried out using a developer containing benzyl alcohol.

22. A process for forming a photographic image as in claim 17, 18 or 19 wherein $R^9$ is a phenyl group.

23. A process for forming a photographic image as in claim 17, 18 or 19 wherein the alkyl and hydroxyalkyl groups represented by $R^{10}$ or $R^{11}$ contain from 1 to 4 carbon atoms.

24. A process for forming a photographic image as in claim 23, wherein the alkyl and hydroxyalkyl groups represented by $R^{10}$ and $R^{11}$ contain from 1 to 4 carbon atoms.

25. A process for forming a photographic image as in claim 1, 2, 3, 4, 5, 6 or 7 wherein the processing temperature is from about 10° C. to 70° C.

26. A process for forming a photographic image as in claim 25 wherein the processing temperature is from about 20° C. to 60° C.

27. A process for forming a photographic image as in claim 25 wherein the processing temperature is from about 20° C. to 40° C.

28. The process of claim 1, wherein said development processing is with a developer free of aromatic primary amino developing agent.

29. The process of claim 1, wherein R is said alkyl group.

30. The process of claim 1, wherein R is said alkoxyalkyl group.

31. The process of claim 1, wherein R is said hydroxyalkyl group.

32. A process for forming a photographic image as in claim 1, wherein the 4-alkoxy-1-naphthol represented by formula (I) is incorporated into said photographic light-sensitive material in an amount of from about 0.1 g/m$^2$ to 10 g/m$^2$ and wherein said hydrophilic colloid layer is a silver halide emulsion layer.

33. A process for forming a photographic image as in claim 1, wherein said 4-alkoxy-1-naphthol is incorporated into said photographic light-sensitive material in an amount of from 0.2 g/m$^2$ to 5 g/m$^2$ and wherein said hydrophilic colloid layer is a silver halide emulsion layer.

34. A process for forming a photographic image as in claim 32, wherein R is said alkyl group.

35. A process for forming a photographic image as in claim 33, wherein R is said alkyl group.

36. In an image-wise exposed and developed silver halide photographic light-sensitive material comprising a support having coated thereon one or more hydrophilic layer(s), the improvement wherein the image resulting from said development has improved granularity and comprises both a dye and silver and wherein at least one of said layer(s) prior to development contains a 4-alkoxy-1-naphthol represented by the formula (I)

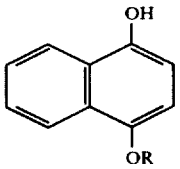

(I)

wherein R represents an alkyl group, an alkoxy-alkoxy group, or a hydroxyalkul group, and the number of carbon atoms in the substituent represented by R is from 1 to 4.

37. The material of claim 36, wherein the 4-alkoxy-1-naphthol represented by formula (I) is incorporated into said photographic light-sensitive material in an amount of from about 0.1 g/m$^2$ to 10 g/m$^2$.

38. The material of claim 36, wherein said 4-alkoxy-1-naphthol is incorporated into said photographic light-sensitive material in an amount of from 0.2 g/m$^2$ to 5 g/m$^2$.

39. The material of claim 36, wherein the 4-alkoxy-1-naphthol represented by formula (I) is incorporated into said photographic light-sensitive material in an amount of from about 0.1 g/m$^2$ to 10 g/m$^2$ and wherein said hydrophilic colloid layer is a silver halide emulsion layer.

40. The material of claim 36, wherein said 4-alkoxy-1-naphthol is incorporated into said photographic light-sensitive material in an amount of from 0.2 g/m$^2$ to 5 g/m$^2$ and wherein said hydrophilic colloid layer is a silver halide emulsion layer.

41. The material of claim 39, wherein R is said alkyl group.

42. The material of claim 40, wherein R is said alkyl group.

* * * * *